United States Patent [19]

Benseler

[11] 4,106,223

[45] Aug. 15, 1978

[54] SKI BOOT

[75] Inventor: Hans Benseler, Hemmingen, Fed. Rep. of Germany

[73] Assignee: PUMA-Sportschunfabriken Rudolf Dassler KG., Nüremberg, Fed. Rep. of Germany

[21] Appl. No.: 780,039

[22] Filed: Mar. 22, 1977

[30] Foreign Application Priority Data

Mar. 27, 1976 [DE] Fed. Rep. of Germany ..... 2613266

[51] Int. Cl.[2] ..... A43B 5/04

[52] U.S. Cl. ..... 36/117

[58] Field of Search ..... 36/117, 118, 119, 120, 36/121, 25 R, 30 R, 32 R, 76 R, 76 C, 69

[56] References Cited

U.S. PATENT DOCUMENTS

| | | | |
|---|---|---|---|
| 3,490,155 | 1/1970 | Herunter | 36/117 X |
| 3,613,270 | 10/1971 | Eie | 36/117 |
| 3,740,873 | 6/1973 | Sturany | 36/117 |

FOREIGN PATENT DOCUMENTS 2,431,692 1/1975 Fed. Rep. of Germany.

*Primary Examiner*—Patrick D. Lawson
*Attorney, Agent, or Firm*—Walter Becker

[57] ABSTRACT

A ski boot which is connected to a ski by means of the tip (projection) of its sole. The tip extends beyond the leg of the boot and the sole essentially comprises rubber or similar synthetic material. The sole is provided with an insert comprising a plate of steel or similar material which extends to the tip of the sole up to the region of the fastening means which connect the ski boot to the ski.

11 Claims, 2 Drawing Figures

SKI BOOT

The present invention relates to a ski boot which is connected with the ski by means of the tip (projection) of its sole. The tip extends beyond the leg of the boot and the sole essentially comprises rubber or rubber-like synthetic material.

It is an object of the present invention to so improve the connection between the ski boot and the ski that as long as a flexible connection between the ski boot and the ski is maintained, great lateral guiding forces may be transferred from the ski boot to the ski or vice versa.

Figure 1:
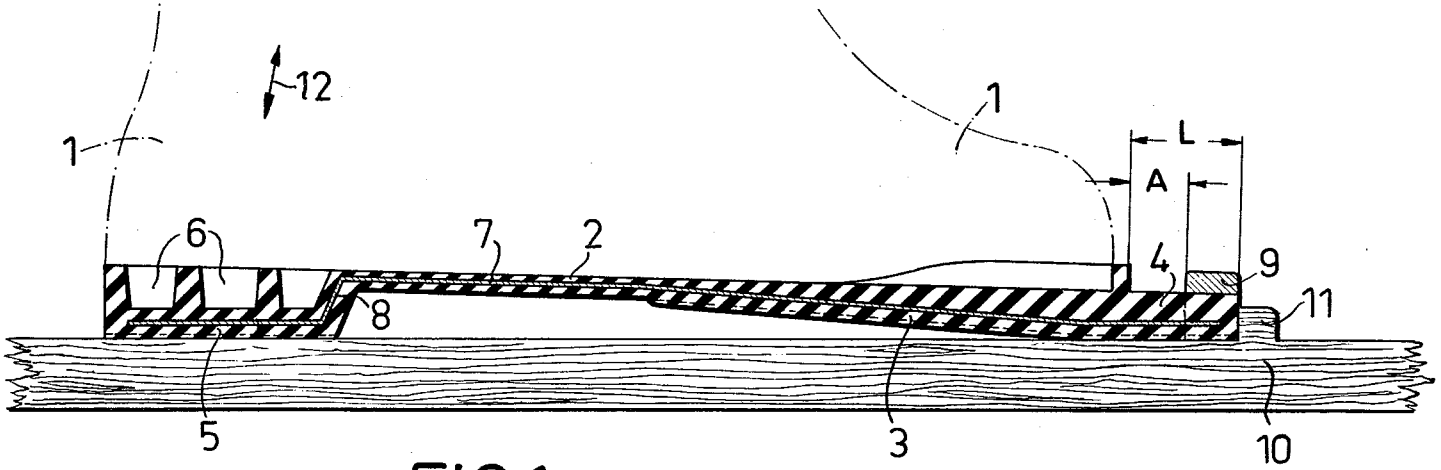
Figure 2:
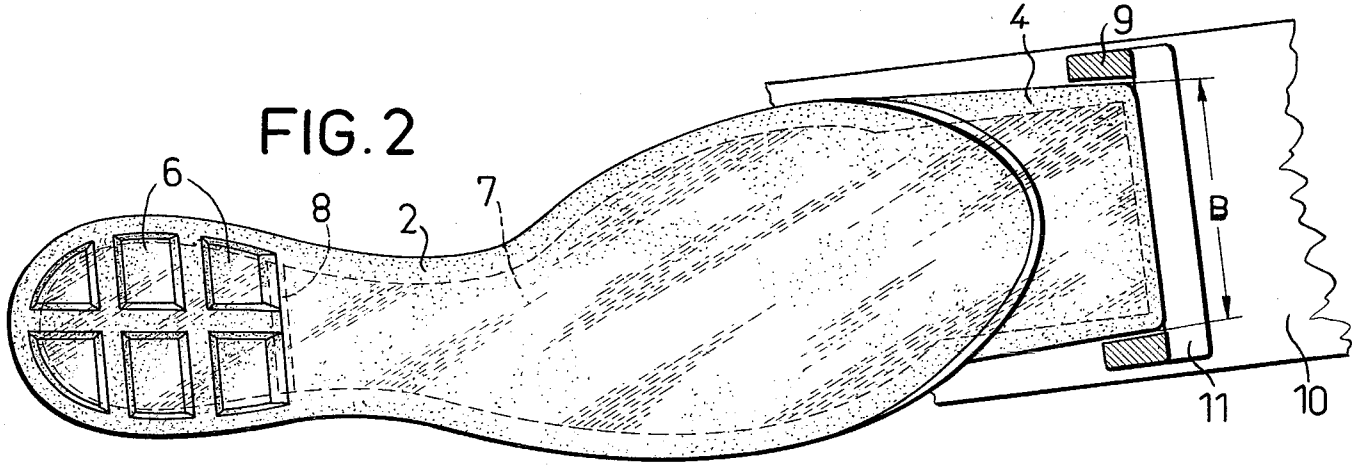

This object and other objects and advantages of the present invention will appear more clearly from the following specification in connection with the accompanying drawing, in which:

FIG. 1 schematically illustrates a vertical longitudinal section of a ski boot pursuant to the present invention fastened to a ski, and FIG. 2 is a top view of the sole of the ski boot of FIG. 1.

The ski boot of the present invention is characterized primarily in that the sole of the ski boot is provided with an insert comprising a steel plate which extends to the tip of the sole up to the region of the fastening means which connect the tip of the sole to the ski.

Such insert comprising a steel plate or the like, specifically of a highly flexible material, has the advantage that a flexible connection between the ski boot and the ski may occur, but that a deformation transverse to the sole is not possible, so that accordingly, comparatively great lateral forces may be transferred.

The fastening means which connect the tip of the sole with the ski may be of any desired type. Bindings may be used as well as screws or bolts which go through the tip of the ski boot. It is important in this connection that between these fastening means and the front end of the leg of the boot or start of the projection, a region remains which makes possible the above mentioned flexible connection between the ski and the ski boot.

The steel plate is expediently firmly connected with the sole by means of vulcanization or the like. In order, moreover, to be able to adequately positively anchor the steel plate, the latter should preferably extend at least over a third of the length of the sole. Additionally, in order that relatively great lateral forces may be transferred, the steel plated insert, in the region of the tip of the sole, should, as far as possible, have a width which is greater than one-third of the width of the sole.

The ski boot is connected with the ski preferably exclusively by means of the above mentioned tip of the sole. However, the present invention does not exclude additional fastening means which can engage the back of the ski boot. If, however, the reinforcing insert within the tip of the sole and in the form of the above mentioned steel plate, has a sufficient width, it is advantageously possible to readily connect the ski boot with the ski exclusively by means of the tip of the ski boot.

Referring now to the drawing in detail, the ski boot has a leg 1 and a sole 2 of rubber or rubber-like material. The sole 2, which is glued or fastened to the ski boot in a manner known per se, essentially comprises the outer sole 3 and the heel 5 which has recesses 6 in its inside. The sole 2 has at its tip a projection 4 which extends about 30mm beyond the front of the boot. A thin-walled insert 7 is arranged within the sole 2. The insert 7 is a highly flexible steel plate which is firmly connected with the material of the sole 2 and which extends from the back of the heel 5, over a step 8 at the front of the heel 5, up to the front of the projection 4. The thickness of the insert 7 is preferably about 0.2 – 0.5mm.

As shown in FIG. 2, the insert 7 extends through practically the entire length and width of the projection 4. In this connection, it is expedient that the width B of the insert 7 in the region of the projection 4 is twice as large as the length L of the projection 4. It is important that the length L be so chosen that at the free end of the projection 4 a positive fastening between the projection 4 of the ski boot and the ski 10 is possible by means of bindings 9 or other fastening means. The ski 10 may be provided with an abutment 11 for engaging the projection 4. Between the bindings 9 and the front end of the leg 1 there must remain a region A which enables a bending deformation of the projection 4 in order thus to be able to raise and lower the ski boot in a customary fashion in the direction of the double arrow 12, while at the same time a lateral movement of the ski boot relative to the ski 10, or a transverse movement of the ski 10 relative to the ski boot, is impossible.

The bindings 9 may also be replaced by screws which go through the projection 4 at the free end and are then screwed to the ski 10.

Instead of a steel plate, a plate of similar strong material may also be used.

It is, of course, to be understood that the present invention is by no means limited to the specific showing of the drawing, but also encompasses any modifications within the scope of the appended claims.

What I claim is:

1. In combination with a long run ski, a boot including a toe and comprising therewith: a sole having a longitudinal axis and a forward projection which extends substantially beyond the toe of said boot;

fastening means for fastening only said forward projection of said sole to a ski;

and an insert arranged exclusively within said sole and extending particularly into said forward projection of said sole at least as far as said fastening means to prevent any damaging break within said forward projection, at least that portion of said insert which is in said forward projection of said sole being flexible simultaneously to allow a sufficient turn resistance assured with loading arising transverse to the longitudinal axis.

2. A ski boot combination according to claim 1, in which the material for said sole is of rubbery material.

3. A ski boot combination according to claim 2, in which said insert is a steel plate.

4. A ski boot combination according to claim 3, in which said insert is firmly connected with said sole.

5. A ski boot combination according to claim 4, in which said insert extends over at least one-third of the length of said sole.

6. A ski boot combination according to claim 5, in which said ski boot has a heel and back said insert extending up to the back of said heel.

7. A ski boot combination according to claim 5, in which said insert in the region of said forward projection of said sole has a width greater than one-third of the maximum width of said sole.

8. A ski boot combination according to claim 5, in which that portion of said insert which is in the region of said forward projection of said sole has a width which is approximately twice as great as the length of said portion of said insert which is in said forward projection of said sole.

9. A ski boot combination according to claim 5, in which said fastening means are arranged at the front of said forward projection of said sole so that a gap exists between said fastening means and the toe of said boot.

10. A ski boot combination according to claim 5, in which that portion of said insert which is in the region of said forward projection of said sole is covered all around above and below with the same material of which said sole primarily consists.

11. A ski boot combination according to claim 10, in which that portion of said insert which is in the region of said forward projection of said sole is also covered all around on its sides and in front with the same material of which said sole primarily consists.

* * * * *

UNITED STATES PATENT OFFICE

CERTIFICATE OF CORRECTION

Patent No. 4,106,223 Dated August 15, 1978

Inventor(s) Hans Benseler

It is certified that error appears in the above-identified patent and that said Letters Patent are hereby corrected as shown below:

[73] Assignee: PUMA-Sportschuhfabriken Rudolf Dassler KG., Nürnberg, Fed. Republic of Germany Signed and Sealed this

*Third* Day of *April 1979*

[SEAL]

*Attest:*

RUTH C. MASON
*Attesting Officer*

DONALD W. BANNER
*Commissioner of Patents and Trademarks*